United States Patent [19]

Anahara et al.

[11] Patent Number: 4,476,672

[45] Date of Patent: Oct. 16, 1984

[54] AIR NOZZLE FOR FASCIATED YARN SPINNING

[75] Inventors: Meiji Anahara; Kazuo Seiki, both of Kariya; Hiroshi Omori, Aichi, all of Japan

[73] Assignee: Kabushiki Kaisha Toyoda Jidoshokki Seisakusho, Aichi, Japan

[21] Appl. No.: 446,381

[22] Filed: Dec. 2, 1982

[30] Foreign Application Priority Data

Dec. 15, 1981 [JP] Japan ..... 56-200896

[51] Int. Cl.[3] ..... D01H 1/13; D01H 7/898

[52] U.S. Cl. ..... 57/333

[58] Field of Search ..... 57/332, 333, 908, 350

[56] References Cited

U.S. PATENT DOCUMENTS 3,445,995 5/1969 Bell et al. ..... 57/333 X 4,114,358 9/1978 Tsuchida et al. ..... 57/333 X

*Primary Examiner*—Donald Watkins

*Attorney, Agent, or Firm*—Burgess, Ryan & Wayne

[57] ABSTRACT

An air nozzle utilized for false-twisting a fiber bundle to form a fasciated yarn, comprising, in series, an inlet and a fiber passage provided with at least a jet for generating a vortex within the fiber passage. The inlet has an opening of a flattened shape having upper and lower walls longer than the side walls thereof and has a size decreasing toward the fiber passage. The edge portion of the ribbon-like fiber bundle passing through the air nozzle strongly contacts the upper and lower walls of the inlet during the twisting operation by the vortex. As a result of frictional resistance with the walls, the twist angle of the edge portion fibers becomes less than that of the core portion fibers. This causes a tightly fasciated effect of the edge portion fibers onto the core portion fibers during the untwisting operation.

6 Claims, 4 Drawing Figures

AIR NOZZLE FOR FASCIATED YARN SPINNING

BACKGROUND OF THE INVENTION

1. Field of the Invention

This invention relates to an air nozzle for fasciated yarn spinning. More specifically, this invention relates to an air nozzle utilized for continuously imparting false-twists to a fiber bundle supplied from a pair of delivery rollers such as front draft rollers of a draft means, thereby entangling the surface portion fibers of the fiber bundle around the core portion thereof to form a so-called "fasciated yarn".

2. Description of the Prior Art

In fasciated yarn spinning, it is necessary to effectively suck a fiber bundle attenuated by draft rollers into an air nozzle and to false-twist it therein. If the suction is not sufficient, part of the fiber bundle supplied from the front draft rollers is not smoothly introduced into the air nozzle but is wound onto the rollers by the sticking of the fibers to the roller surface or blown away by the air streams accompanying the high speed rotation of the rollers. This winding of the fibers onto the rollers or blowing away of the fibers causes trouble in the spinning operation, contamination of the working environment, and reduction of the material yield.

In Japanese Examined Patent Publication (Kokoku) No. 43-28250, a device is disclosed in which a suction nozzle for sucking a fiber bundle is provided downstream of a pair of delivery rollers and, further, another nozzle for twisting the fiber bundle is provided downstream of the suction nozzle. According to the above-mentioned device, the suction effect is considerably improved by the independent suction nozzle. However, the device suffers from many problems, such as the increased size of the overall installation due to the additional twisting nozzle, troublesome maintenance; and increased air consumption.

On the other hand, in Japanese Unexamined Patent Publication (Kokai) No. 53-90433, there is disclosed a device having only one nozzle utilized for simultaneously sucking and twisting a fiber bundle. However, the nozzle does not satisfactorily perform well-balanced sucking and twisting because of its structure. Particularly, the suction effect is insufficient due to its conical-shaped inlet structure.

SUMMARY OF THE INVENTION

The inventors conducted various studies so as to develope an air nozzle which enables effective sucking and twisting simultaneously in one nozzle. They found that a specific form of the inlet enhances the sucking function of the air nozzle.

Specifically, in accordance with the present invention, there is provided an air nozzle utilized for fasciated yarn spinning disposed downstream of a pair of draft rollers, comprising an inlet and a fiber passage in series, the fiber passage being provided with at least a jet forwardly inclined to and deviated from the axis of the fiber passage, characterized in that the inlet has an opening of a flattened shape along the rotational axes of the draft rollers and in that the cross-sectional size of the inlet gradually decreases toward the fiber passage.

BRIEF DESCRIPTION OF THE DRAWINGS

The invention will now be explained in detail in reference to the accompanying drawings, in which.

DETAILED DESCRIPTION OF THE INVENTION

Figure 1:
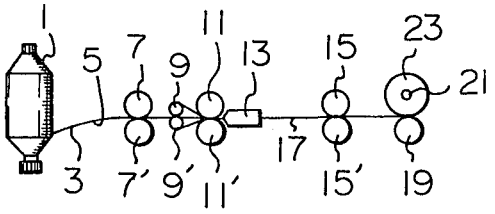
FIG. 1 is a side view of a fasciated yarn spinning apparatus in which an air nozzle according to the present invention is utilized.

FIG. 1 shows a fasciated yarn spinning apparatus. A fiber bundle 3 withdrawn from a supply bobbin 1 is introduced through a guide 5 between a pair of back rollers 7, 7' and is drafted by a pair of aprons 9, 9' and a pair of front rollers 11, 11'. The fiber bundle 3 is then introduced into an air nozzle 13 and is withdrawn by a pair of draw-off rollers 15, 15'. In the air nozzle 13, the fiber bundle 3 is first twisted, then untwisted in the downstream region by a vortex, thereby entangling the surface portion fibers of the fiber bundle 3 around the core portion thereof to form a fasciated yarn 17. The fasciated yarn 17 is wound onto a bobbin 21 frictionally driven by a drum 19 to form a yarn package 23.

Figure 3:
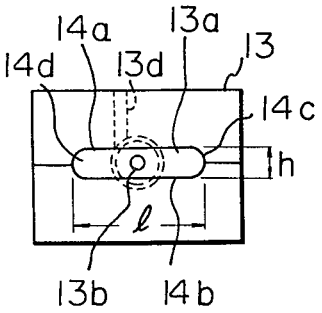
FIG. 3 is a front view of the air nozzle shown in FIG. 2.
Figure 2:
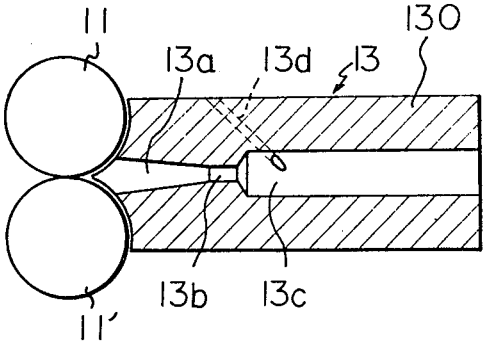
FIG. 2 is a sectional side view of an air nozzle according to the present invention.

The air nozzle 13 according to the present invention will now be explained referring to FIG. 2. The body 130 of the air nozzle 13 has a front portion shaped complementary to the front draft rollers 11, 11' so that the nozzle 13 can be disposed close to the front draft rollers 11, 11'. An inlet **13*a*, a narrow fiber passage 13*b*, and a wide fiber passage 13*c* are arranged in series in the body 130. A jet 13*d* extends through the body 130 to open on the inner wall of the fiber passage 13*b* or 13*c*. The height of the inlet 13*a* preferably gradually decreases toward the narrow fiber passage 13*b*, as shown in FIG. 2. As seen from the front draft roller side (refer to FIG. 3), the inlet 13*a* is of a somewhat flattened shape along the rotational axes of the front draft rollers 11, 11'. More specifically, the inlet opening is formed by upper and lower edges 14*a*, 14*b* of the inlet 13*a*, linearly extending toward the horizontal direction, and side edges 14*c*, 14*d* in the shape of short arcs connecting the upper and lower edges 14*a* 14*b*, as shown in FIG. 3. The ratio between the width l of the longer edge 14*a* or 14*b* and the height h of the shorter edge 14*c* and 14*d*** is preferably in the range from 3:1 to 10:1 because of the reasons described below.

In fasciated yarn spinning, the fiber bundle is transferred in a ribbon-like form, i.e., flattened and spread by means of draft rollers. Accordingly, if the inlet of the air nozzle is of a circular shape or the like, there are large spaces between the upper and lower surfaces of the fiber bundle and the upper and lower walls of the inlet, thereby a considerable amount of air is sucked into the air nozzle through the above-mentioned spaces and, therefore, the suction force for the fiber bundle decreases correspondingly. On the contrary, as the spaces between the fiber bundle and the walls of the inlet become smaller, i.e., as the shape of the inlet opening is closer to that of a cross-section of the spread fiber bundle, the speed of the suction stream becomes faster and, therefore, the suction force becomes stronger. However, since the edge portion of the fiber bundle is likely to be disturbed by the air streams accompanying the rotation of the rollers and by adhesion of the fibers to the roller surface, the surface thereof is not so smooth. As a result, if the inlet is excessively flattened, such as over 10:1, the air sucked through the side spaces of the inlet will increase and aggravate the above-mentioned disturbance.

As stated hereinbefore, since the cross-sectional size of the inlet 13*a* decreases toward the narrow fiber passage 13*b*, the suction stream heading toward the narrow fiber passage 13*b* from the inlet opening can be smoothly accelerated without causing turbulence. The suction force occurs due to inclination of the jet 13*d* relative to the wide fiber passage 13*c*. The air ejected from the jet 13*d* causes a vortex within the wide fiber passage 13*c* due to deviation of the jet 13*d* from the axis of the fiber passage 13*c*. The vortex twists the fiber bundle 3. According to the present invention, since the cross-section of the inlet is of a flattened shape, the edge portion fibers of the flattened fiber bundle contact the upper and lower walls of the inlet during rotation by the twisting operation of the vortex. Due to the frictional resistance between the fiber bundle and the inlet wall, the edge portion fibers with free ends not being embedded in the core portion cannot rotate as freely as the core portion and, therefore, entangle about the core portion with a smaller twist angle. When the fiber bundle is untwisted in the next stage of the operation, the edge portion fibers with the smaller twist angle are fasciated to the core portion of the fiber bundle with a number of twists corresponding to the difference between the two portions.

Figure 4:
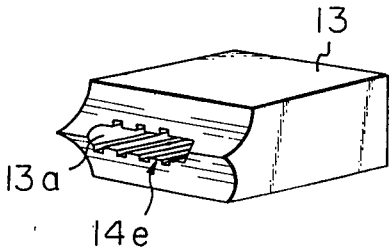
FIG. 4 is an oblique view of another nozzle according to the present invention.

To enhance the above-mentioned fasciated effect, it is preferable to provide a plurality of narrow grooves 14*e* on the inner wall of the inlet 13*a*, as shown in FIG. 4, to prevent the rotation of the edge portion fibers during the twisting operation. A rough surface can be substituted for the grooves 14*e*. These grooves 14*e* or the rough surface may be formed all over the inner walls of the inlet 13*a*. However, it is effective to provide them only on the upper and lower walls of the inlet, because there is less opportunity for contact of the fiber bundle with the side walls than with the upper and lower walls.

In the above-mentioned embodiment, the nozzle is disposed behind the front draft rollers of the drafting unit. However, the nozzle may be arranged behind any rollers provided the rollers are the last one of the draft roller group.

Further, the cross-sectional shape of the inlet is not confined to a semi rectangular one as shown in the drawings, but may be other shapes, such as ellipses, provided they are of the flattened shape defined hereinbefore. The selection of the shapes should be made in consideration of boring techniques.

According to the present invention, the suction force of the air nozzle is effectively improved by its flattened-shaped inlet. Therefore, the fiber bundle can be stably and steadily introduced into the air nozzle. This decreases the chances of winding of fibers onto the draft rollers or of generation of fly wastes and improves the yield of the spinning process. In addition, since the edge portion of the fiber bundle strongly contacts the inner walls of the flat inlet during the twisting operation, the number of twists of the free end fibers of the edge portion is suppressed to a certain degree suitable for tightly entangling around the core portion of the fiber bundle to form a well-fasciated yarn during the succeeding untwisting operation.

We claim:

1. An air nozzle utilized for fasciated yarn spinning and disposed downstream of a pair of draft rollers, comprising an inlet and a fiber passage in series, said fiber passage being provided with at least one jet forwardly inclined to and deviated from the axis of said fiber passage, said inlet having an opening of a substantially flattened shape along the rotational axes of said draft rollers, with the cross-sectional size of said inlet gradually decreasing both in height and width toward said fiber passage.

2. An air nozzle according to claim 1, wherein said inlet opening has upper and lower walls of a length relative to the height between said walls such that l/h is within a range from 3 to 10, where l is the length of said upper or lower wall and h is said height.

3. An air nozzle utilized for fasciated yarn spinning and disposed downstream of a pair of draft rollers, comprising an inlet and a fiber passage in series, said fiber passage being provided with at least one jet forwardly inclined to and deviated from the axis of said fiber passage, said inlet having:

an opening of a substantially flattened shape along the rotational axes of said draft rollers, a cross-sectional size gradually decreasing toward said fiber passage, and an obstacle on inner walls thereof for frictionally preventing rotation of said fiber bundle during the twisting operation.

4. An air nozzle according to claim 3, wherein said obstacle is a plurality of grooves.

5. An air nozzle according to claim 3, wherein said obstacle is a rough surface.

6. An air nozzle according to claim 3, 4 or 5 wherein said inlet opening has upper and lower walls of a length relative to the height between said walls such that l/h is within a range form 3 to 10, where l is the length of said upper or lower wall and h is said height.

* * * * *